US009068765B2

(12) United States Patent
Huff

(10) Patent No.: US 9,068,765 B2
(45) Date of Patent: Jun. 30, 2015

(54) REFRIGERATION STORAGE IN A REFRIGERANT VAPOR COMPRESSION SYSTEM

(75) Inventor: Hans-Joachim Huff, Mainz-Kostheim (DE)

(73) Assignee: CARRIER CORPORATION, Farmington, CT (US)

( * ) Notice: Subject to any disclaimer, the term of this patent is extended or adjusted under 35 U.S.C. 154(b) by 354 days.

(21) Appl. No.: 13/517,136

(22) PCT Filed: Jan. 19, 2011

(86) PCT No.: PCT/US2011/021685

§ 371 (c)(1),
(2), (4) Date: Jun. 19, 2012

(87) PCT Pub. No.: WO2011/091014

PCT Pub. Date: Jul. 28, 2011

(65) Prior Publication Data

US 2012/0285185 A1 Nov. 15, 2012

Related U.S. Application Data

(60) Provisional application No. 61/296,661, filed on Jan. 20, 2010.

(51) Int. Cl.

| | |
|---|---|
| ***F25B 1/00*** | (2006.01) |
| ***F25B 1/10*** | (2006.01) |
| ***F25B 9/00*** | (2006.01) |

(52) U.S. Cl.

CPC . *F25B 1/10* (2013.01); *F25B 9/008* (2013.01); *F25B 2309/061* (2013.01); *F25B 2400/13* (2013.01); *F25B 2400/23* (2013.01); *F25B 2500/01* (2013.01)

(58) Field of Classification Search

CPC ..... F25B 43/043; F25B 49/002; F25B 1/10; F25B 13/00; F25B 43/006

USPC ..... 62/115, 186, 190, 222, 498, 500, 509; 165/253

See application file for complete search history.

(56) References Cited

U.S. PATENT DOCUMENTS 3,213,633 A * 10/1965 Rosenstein et al. ..... 62/535
4,176,529 A 12/1979 Stierlin et al.

(Continued)

FOREIGN PATENT DOCUMENTS

CN 1894548 A 1/2007
CN 101512255 A 8/2009

(Continued)

OTHER PUBLICATIONS

International Search Report mailed Nov. 28, 2011, 4 pgs.

(Continued)

*Primary Examiner* — Melvin Jones
(74) *Attorney, Agent, or Firm* — Cantor Colburn LLP

(57) ABSTRACT

A refrigerant vapor compression system (10) includes a plurality of components, including a flash tank (70), connected in a refrigerant flow circuit by a plurality of refrigerant lines (2, 4, 6, 8). The system internal volume equals to the sum of the internal volumes of the plurality of components and the internal volume of the plurality of refrigerant lines. The internal volume of the flash tank ranges from at least 10% to about 30% of the total system internal volume.

19 Claims, 2 Drawing Sheets

(56) References Cited

U.S. PATENT DOCUMENTS

| | | | | | |
|---|---|---|---|---|---|
| 5,056,329 | A | * | 10/1991 | Wilkinson | 62/197 |
| 5,199,275 | A | | 4/1993 | Martin | |
| 5,287,705 | A | | 2/1994 | Roehrich et al. | |
| 5,320,167 | A | | 6/1994 | Johnson et al. | |
| 5,331,824 | A | | 7/1994 | Miller et al. | |
| 5,692,389 | A | * | 12/1997 | Lord et al. | 62/222 |
| 5,694,776 | A | | 12/1997 | Sahm | |
| 5,730,216 | A | | 3/1998 | Viegas et al. | |
| 5,848,537 | A | * | 12/1998 | Biancardi et al. | 62/324.6 |
| 5,946,928 | A | | 9/1999 | Wiggs | |
| 6,385,980 | B1 | | 5/2002 | Sienel | |
| 6,460,352 | B1 | | 10/2002 | Lemcoff et al. | |
| 6,609,382 | B2 | | 8/2003 | Vander Woude et al. | |
| 6,708,510 | B2 | | 3/2004 | Sulc et al. | |
| 6,941,769 | B1 | | 9/2005 | Hill, IV et al. | |
| 7,089,751 | B2 | | 8/2006 | Fleming, Jr. et al. | |
| 7,096,679 | B2 | * | 8/2006 | Manole | 62/115 |
| 7,231,776 | B2 | | 6/2007 | Casar et al. | |
| 7,451,617 | B2 | | 11/2008 | Renz et al. | |
| 2005/0132729 | A1 | | 6/2005 | Manole | |
| 2009/0250190 | A1 | | 10/2009 | Siegenthaler | |

FOREIGN PATENT DOCUMENTS

| | | | |
|---|---|---|---|
| DE | 10358428 | A1 | 7/2007 |
| EP | 1990587 | | 11/2008 |
| WO | 2007111594 | A1 | 10/2007 |
| WO | 2007111595 | A1 | 10/2007 |
| WO | 2008039204 | | 4/2008 |
| WO | 2008054380 | A2 | 5/2008 |
| WO | 2008130357 | A1 | 10/2008 |
| WO | 2008130358 | A1 | 10/2008 |
| WO | 2008140454 | A1 | 11/2008 |
| WO | 2009082405 | A1 | 7/2009 |
| WO | 2009091400 | | 7/2009 |

OTHER PUBLICATIONS

Singapore Search Report and Written Opinion for International Application No. PCT/US2011/021685, Nov. 15, 2013, 17 pages.

International Preliminary Report on Patentability mailed Aug. 2, 2012.

European Office Action for application EP 11705063.3, dated Feb. 10, 2015, 6 pages.

* cited by examiner

REFRIGERATION STORAGE IN A REFRIGERANT VAPOR COMPRESSION SYSTEM

CROSS-REFERENCE TO RELATED APPLICATION

This application claims priority to U.S. Provisional Patent Application Ser. No. 61/296,661 entitled "Refrigeration Storage in a Refrigerant Vapor Compression System" filed on Jan. 20, 2010. The content of this application is incorporated herein by reference in its entirety.

FIELD OF THE INVENTION

This invention relates generally to refrigerant vapor compression systems and, more particularly, to providing an adequate buffer volume for refrigerant storage in the refrigerant circuit of a refrigerant vapor compression system, most particularly, a refrigerant vapor compression system operating in a transcritical cycle with carbon dioxide as the refrigerant.

BACKGROUND OF THE INVENTION

Refrigerant vapor compression systems are well known in the art and commonly used for conditioning air to be supplied to a climate controlled comfort zone within a residence, office building, hospital, school, restaurant or other facility. Refrigerant vapor compression system are also commonly used in refrigerating air supplied to display cases, merchandisers, freezer cabinets, cold rooms or other perishable/frozen product storage areas in commercial establishments. Refrigerant vapor compression systems are also commonly used in transport refrigeration systems for refrigerating air supplied to a temperature controlled cargo space of a truck, trailer, container or the like for transporting perishable/frozen items by truck, rail, ship or intermodal. Refrigerant vapor compression systems used in connection with transport refrigeration systems are generally subject to more stringent operating conditions due to the wide range of operating load conditions and the wide range of outdoor ambient conditions over which the refrigerant vapor compression system must operate to maintain product within the cargo space at a desired temperature at which the particular product being stowed in the cargo space needs to be controlled can also vary over a wide range depending on the nature of cargo to be preserved.

The basic components of a refrigerant vapor compression system include a refrigerant compression device, a refrigerant heat rejection heat exchanger, and a refrigerant heat absorption heat exchanger, and an expansion device, commonly an expansion valve, disposed upstream, with respect to refrigerant flow, of the refrigerant heat absorption heat exchanger and downstream of the refrigerant heat rejection heat exchanger. These basic refrigerant system components are interconnected by refrigerant lines in a closed refrigerant circuit, arranged in a conventional manner in accord with a refrigerant vapor compression cycle. Such refrigerant vapor compression systems may be designed for and operated in a subcritical pressure range or in a transcritical pressure range depending upon the particular refrigerant with which the system is charged.

In refrigerant vapor compression systems operating in a subcritical cycle, the refrigerant heat rejection heat exchanger functions as a refrigerant vapor condenser. However, in refrigerant vapor compression systems operating in a transcritical cycle, the refrigerant heat rejection heat exchanger functions as a refrigerant vapor cooler, commonly referred to as a gas cooler, rather than a condenser. Whether the refrigerant vapor compression system is operated in a subcritical cycle or in a transcritical cycle, the refrigerant heat absorption heat exchanger functions as a refrigerant evaporator. In operation in a subcritical cycle, both the condenser and the evaporator heat exchangers operate at refrigerant temperatures and pressures below the refrigerant's critical point. However, in refrigerant vapor compression systems operating in a transcritical cycle, the gas cooler operates at a refrigerant temperature and pressure in excess of the refrigerant's critical point, while the evaporator operates at a refrigerant temperature and pressure in the subcritical range. Thus, for a refrigerant vapor compression system operating in a transcritical cycle, the difference between the refrigerant pressure within the gas cooler and refrigerant pressure within the evaporator is characteristically substantially greater than the difference between the refrigerant pressure within the condenser and the refrigerant pressure within the evaporator for a refrigerant vapor compression system operating in a subcritical cycle.

As refrigerant vapor compression systems are often operated in applications having a wide range of refrigeration load demand, it is known to provide a buffer volume into the system refrigerant circuit in which excess refrigerant collects and is stored during low load demand operation or during system standstill between periods of operation. In refrigeration vapor compression systems operating in a subcritical cycle, the buffer volume for storing refrigerant may be typically provided by incorporating a receiver into the refrigerant circuit to receive liquid refrigerant from the condenser or by incorporating an accumulator into the refrigerant circuit between the evaporator and the suction inlet to the compression device. In refrigeration vapor compression systems operating in a transcritical critical cycle, the buffer volume for storing refrigerant would not be provided by a receiver because the refrigerant heat rejection heat exchanger operates as a gas cooler, not as a condenser, thus the refrigerant leaving the refrigerant heat rejection heat exchanger is in a vapor state, not a liquid state.

U.S. Pat. No. 7,024,883 discloses incorporating an accumulator in the refrigerant circuit of a refrigerant vapor compression system operable in a transcritical cycle wherein carbon dioxide refrigerant is stored while the system is inactive. The accumulator is designed to have an optimal size for preventing over-pressurization of the system when the refrigerant is at a maximum refrigerant temperature and a maximum refrigerant pressure reached when the system is inactive.

SUMMARY OF THE INVENTION

A refrigerant vapor compression system includes a plurality of components connected in a refrigerant flow circuit by a plurality of refrigerant lines. The components include at least a compression device, a refrigerant heat rejection heat exchanger, a refrigerant heat absorption heat exchanger, and a flash tank. Each of the components defines an internal volume and the plurality of refrigerant lines defines an internal volume. The system internal volume equals to the sum of the internal volumes of the plurality of components and the internal volume of the plurality of refrigerant lines. The internal volume of the flash tank ranges from at least 10% to about 30% of the system volume. In an embodiment of the refrigerant vapor compression system, the internal volume of the flash tank ranges from at about least 20% to about 30% of the system volume. In an embodiment, the internal volume of the flash tank ranges from at least 0.1 cubic feet up to about 0.2 cubic feet. In an embodiment, the internal volume of the flash tank is about 0.15 cubic feet. The flash tank may be disposed in the refrigerant flow circuit between the refrigerant heat rejection heat exchanger and the refrigerant heat absorption heat exchanger. The refrigerant vapor compression system may further include an economizer circuit operatively associated with the refrigerant flow circuit and including a refrigerant vapor injection line connecting the chamber of the flash tank in refrigerant vapor flow communication with an intermediate pressure stage of the compression device. In an embodiment of the refrigerant vapor compression system, the refrigerant is carbon dioxide.

In an aspect, a refrigerant vapor compression system is provided for a transport refrigeration unit for conditioning a cargo space. The refrigerant vapor compression system includes a compression device; a refrigerant heat rejection heat exchanger; at least one expansion device; a refrigerant heat absorption heat exchanger; a flash tank defining a chamber having an internal volume; and a plurality of refrigerant lines connecting the compression device, the refrigerant heat rejection heat exchanger, the at least one expansion device, the refrigerant heat absorption heat exchanger and the flash tank in a refrigerant flow circuit. The internal volume of the flash tank has a volume between at least 10% up to 30% of a total system internal volume. In an embodiment of the refrigerant vapor compression system the internal volume of the flash tank ranges from at about least 20% to about 30% of the system volume. In an embodiment, the internal volume of the flash tank ranges from at least 0.1 cubic feet up to about 0.2 cubic feet. In an embodiment, the internal volume of the charge storage device is about 0.15 cubic feet.

In an embodiment of the refrigerant vapor compression system, the flash tank is disposed in the refrigerant flow circuit between the refrigerant heat rejection heat exchanger and the refrigerant heat absorption heat exchanger, and the at least one expansion device includes a primary expansion device disposed in the refrigerant flow circuit between the flash tank and the refrigerant heat absorption heat exchanger and a secondary expansion device disposed in the refrigerant flow circuit between the refrigerant heat rejection heat exchanger and the flash tank. In conjunction with this embodiment, the plurality of refrigerant lines includes a refrigerant vapor injection line connecting the chamber of the flash tank to refrigerant vapor flow communication with an intermediate pressure stage of the compression device. In this embodiment, the flash tank also functions as an economizer.

In an embodiment, the refrigerant vapor compression system may further include a suction line accumulator interdisposed in the refrigerant flow circuit intermediate the refrigerant heat absorption heat exchanger and a suction inlet to the compression device, the suction line accumulator defining an internal volume, the sum of the internal volume of the flash tank and the internal volume of the suction line accumulator being up to 30% of the total system internal volume.

In an aspect, a method is provided for designing a refrigerant vapor compression system for operation in a transcritical cycle, the refrigerant vapor compression system having at least a compression device, a refrigerant heat rejection heat exchanger, at least one expansion device, and a refrigerant heat absorption heat exchanger connected in a refrigerant flow circuit by a plurality of refrigerant lines. The method includes the steps of: providing a flash tank interdisposed in the refrigerant flow circuit intermediate the refrigerant heat rejection heat exchanger and the refrigerant heat absorption heat exchanger; and sizing an internal volume of the flash tank to provide sufficient volume that at the maximum volume of liquid refrigerant collecting within the flash tank during operation, adequate volume is provided above the maximum liquid level within the flash tank to ensure that the process of separation of the refrigerant vapor and refrigerant liquid will still occur unimpeded. The method may also include the step of sizing the internal volume of the flash tank to have a volume between 10% up to 30% of the total internal volume of the refrigerant vapor compression system.

The total system internal volume may be determined by summing the respective internal volume of each of the plurality of components in the refrigerant flow circuit in which refrigerant may reside, including an internal volume of the compression device, an internal volume of the refrigerant heat rejection heat exchanger, an internal volume of the at least one expansion device, an internal volume of the refrigerant heat absorption heat exchanger, the internal volume of the flash tank, and the total internal volume of the refrigerant lines in the refrigerant flow circuit.

In an embodiment of the refrigerant vapor compression system, the refrigeration may be carbon dioxide and the refrigerant vapor compression system may be operated in a transcritical cycle.

BRIEF DESCRIPTION OF THE DRAWINGS

For a further understanding of the disclosure, reference will be made to the following detailed description which is to be read in connection with the accompanying drawing, where.

DETAILED DESCRIPTION

Figure 1:
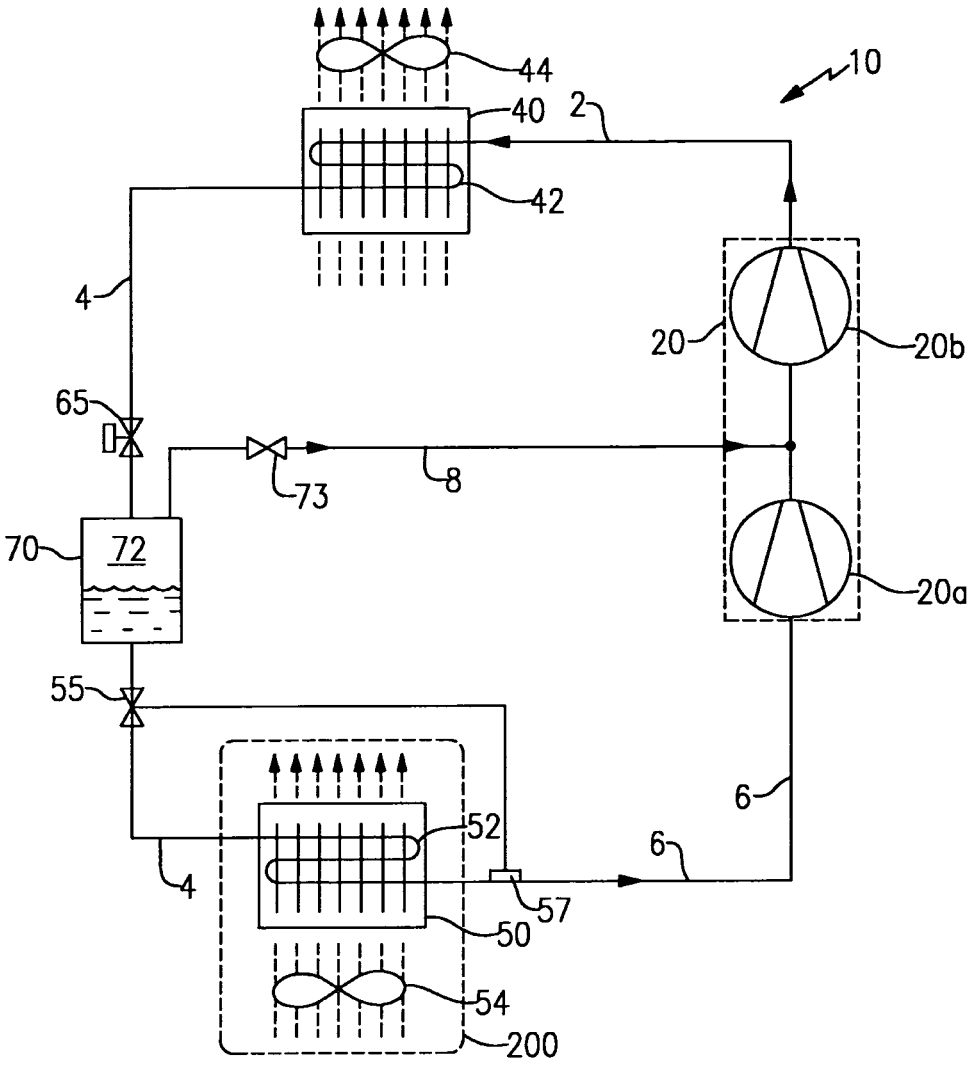
FIG. 1 is a schematic illustration of an exemplary embodiment of a refrigerant vapor compression system operable in a transcritical cycle and incorporating a flash tank in the refrigerant flow circuit.
Figure 2:
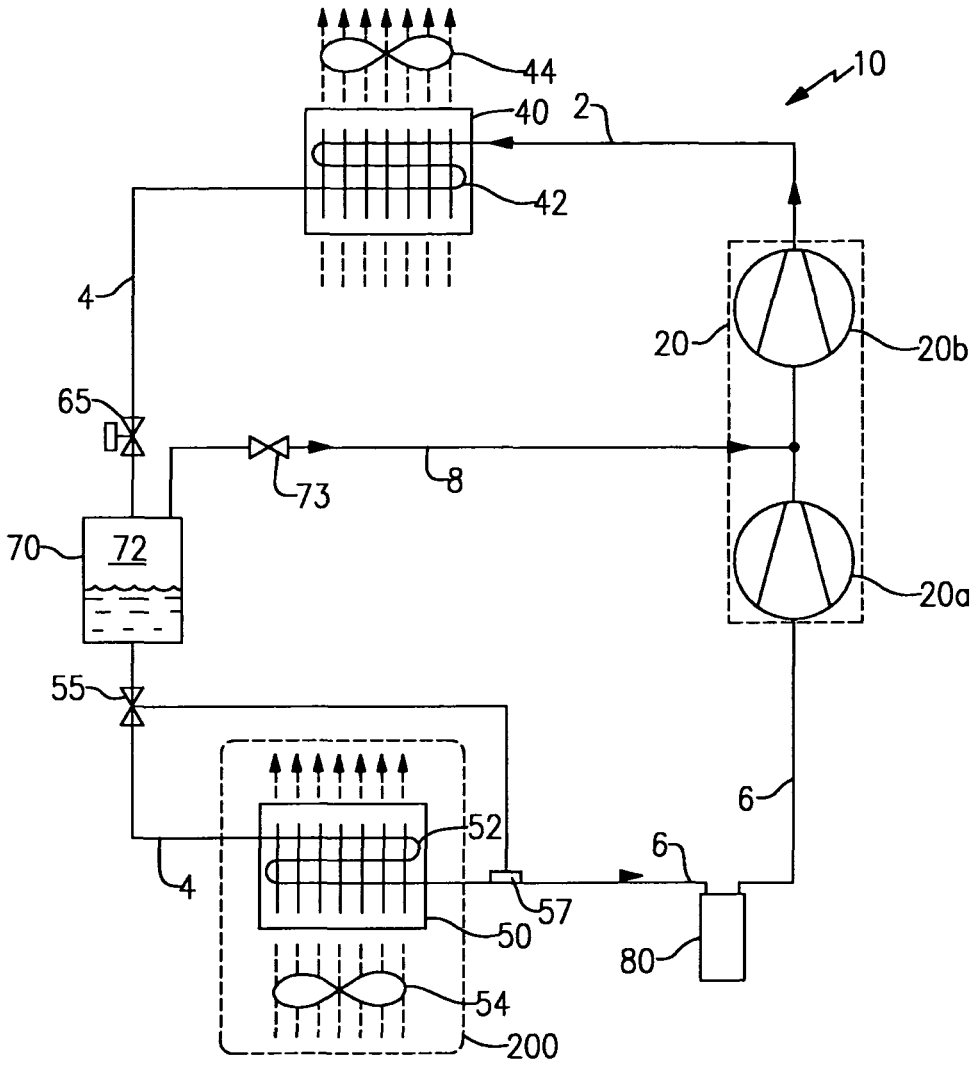
FIG. 2 is a schematic illustration of an exemplary embodiment of a refrigerant vapor compression system operable in a transcritical cycle and incorporating a flash tank and accumulator in the refrigerant flow circuit.

Referring now to FIGS. 1 and 2, there are depicted therein exemplary embodiments of a refrigerant vapor compression system 10 suitable for use in a transport refrigeration unit for conditioning, that is at least cooling, but generally also dehumidifying, the air or other gaseous atmosphere within the temperature controlled cargo space 200 of a truck, trailer, container, intermodal container or like structure for transporting perishable/frozen goods. The refrigerant vapor compression system 10 is also suitable for use in conditioning air to be supplied to a climate controlled comfort zone within a residence, office building, hospital, school, restaurant or other facility. The refrigerant vapor compression system could also be employed in refrigerating air supplied to display cases, merchandisers, freezer cabinets, cold rooms or other perishable/frozen product storage areas in commercial establishments.

The refrigerant vapor compression system 10 is well suited for, and will described herein with respect to, operation in a transcritical cycle with a low critical temperature refrigerant, such as for example, but not limited to, carbon dioxide. However, it is to be understood that the refrigerant vapor compression system 10 may also be operated in a subcritical cycle with a higher critical temperature refrigerant such as conventional hydrochlorofluorocarbon and hydrofluorocarbon refrigerants. The refrigerant vapor compression system 10 includes a multi-step compression device 20, a refrigerant heat rejection heat exchanger 40, a refrigerant heat absorbing heat exchanger 50, also referred to herein as an evaporator, and a primary expansion valve 55, such as for example an electronic expansion valve or a thermostatic expansion valve, operatively associated with the evaporator 50, with refrigerant lines 2, 4 and 6 connecting the aforementioned components in a refrigerant flow circuit. Additionally, the refrigerant vapor compression system 10 of the invention includes a flash tank 70 interdisposed in refrigerant line 4 of the refrigerant flow circuit downstream with respect to refrigerant flow of the refrigerant heat rejection heat exchanger 40 and upstream with respect to refrigerant flow of the refrigerant heat absorption heat exchanger 50. In the embodiment depicted in FIG. 2, the refrigerant vapor compression system also includes a suction line accumulator 80 interdisposed in refrigerant line 6 of the refrigerant flow circuit intermediate the refrigerant outlet of the refrigerant heat absorption heat exchanger 50 and the suction inlet to the compression device 20.

In a refrigerant vapor compression system operating in a transcritical cycle, the refrigerant heat rejection heat exchanger 40 constitutes a gas cooler through which supercritical refrigerant passes in heat exchange relationship with a cooling medium, such as for example, but not limited to ambient air or water, and may be also be referred to herein as a gas cooler, In a refrigerant vapor compression system operating in a subcritical cycle, the refrigerant heat rejection heat exchanger 40 would constitute a refrigerant condensing heat exchanger through which hot, high pressure refrigerant passes in heat exchange relationship with the cooling medium. In the depicted embodiments, the refrigerant heat rejection heat exchanger 40 includes a finned tube heat exchanger 42, such as for example a fin and round tube heat exchange coil or a fin and mini-channel flat tube heat exchanger, through which the refrigerant passes in heat exchange relationship with ambient air being drawn through the finned tube heat exchanger 42 by the fan(s) 44 associated with the gas cooler 40.

The refrigerant heat absorption heat exchanger 50 serves an evaporator wherein refrigerant liquid is passed in heat exchange relationship with a fluid to be cooled, most commonly air, drawn from and to be returned to a temperature controlled environment 200, such as the cargo box of a refrigerated transport truck, trailer or container, or a display case, merchandiser, freezer cabinet, cold room or other perishable/frozen product storage area in a commercial establishment, or to a climate controlled comfort zone within a residence, office building, hospital, school, restaurant or other facility. In the depicted embodiments, the refrigerant heat absorbing heat exchanger 50 comprises a finned tube heat exchanger 52 through which refrigerant passes in heat exchange relationship with air drawn from and returned to the refrigerated cargo box 200 by the evaporator fan(s) 54 associated with the evaporator 50. The finned tube heat exchanger 52 may comprise, for example, a fin and round tube heat exchange coil or a fin and mini-channel flat tube heat exchanger.

The compression device 20 functions to compress the refrigerant and to circulate refrigerant through the primary refrigerant circuit as will be discussed in further detail hereinafter. The compression device 20 may comprise a single multiple stage refrigerant compressor, such as for example a scroll compressor, a screw compressor or a reciprocating compressor, disposed in the primary refrigerant circuit and having a first compression stage 20*a* and a second compression stage 20*b*. The first and second compression stages are disposed in series refrigerant flow relationship with the refrigerant leaving the first compression stage passing directly to the second compression stage for further compression. Alternatively, the compression device 20 may comprise a pair of independent compressors 20*a* and 20*b*, connected in series refrigerant flow relationship in the primary refrigerant circuit via a refrigerant line connecting the discharge outlet port of the first compressor 20*a* in refrigerant flow communication with the suction inlet port of the second compressor 20*b*. In the independent compressor embodiment, the compressors 20*a* and 20*b* may be scroll compressors, screw compressors, reciprocating compressors, rotary compressors or any other type of compressor or a combination of any such compressors.

As noted briefly previously, the refrigerant vapor compression system 10 includes a flash tank 70 interdisposed in refrigerant line 4 of the primary refrigerant circuit downstream with respect to refrigerant flow of the gas cooler 40 and upstream with respect to refrigerant flow of the evaporator 50. A secondary expansion device 65 is interdisposed in refrigerant line 4 in operative association with and upstream of the flash tank 70. The secondary expansion device 65 may be an electronic expansion valve, such as depicted in FIGS. 1 and 2, or a fixed orifice expansion device. Refrigerant traversing the secondary expansion device 65 is expanded to a lower pressure sufficient to establish a mixture of refrigerant in a vapor state and refrigerant in a liquid state. The flash tank 70 defines a chamber 72 wherein refrigerant in the liquid state collects in a lower portion of the chamber and refrigerant in the vapor state collects in the portion of the chamber 72 above the liquid refrigerant.

Liquid refrigerant collecting in the lower portion of the flash tank 70 passes therefrom through refrigerant line 4 and traverses the primary refrigerant circuit expansion device 55 interdisposed in refrigerant line 4 upstream with respect to refrigerant flow of the evaporator 50. As this liquid refrigerant traverses the primary expansion device 55, it expands to a lower pressure and temperature before entering enters the evaporator 50. In traversing the evaporator 50, the expanded refrigerant passes in heat exchange relationship with the air to be cooled, whereby the refrigerant is vaporized and typically superheated. As in conventional practice, the primary expansion device 55 meters the refrigerant flow through the refrigerant line 4 to maintain a desired level of superheat in the refrigerant vapor leaving the evaporator 50 to ensure that no liquid is present in the refrigerant leaving the evaporator. The low pressure refrigerant vapor leaving the evaporator 50 returns through refrigerant line 6 to the suction port of the first compression stage or first compressor 20*a* of the compression device 20 as depicted in FIG. 1.

The refrigerant vapor compression system 10 also includes a refrigerant vapor injection line 18. The refrigerant vapor injection line 18 establishes refrigerant flow communication between an upper portion of the chamber 72 of the flash tank 70 and an intermediate stage of the compression process. In the exemplary embodiment of the refrigerant vapor compression system 10 depicted in FIG. 1, injection of refrigerant vapor into an intermediate pressure stage of the compression process would be accomplished by injection of the refrigerant vapor into the refrigerant passing from the first compression stage 20*a* into the second compression stage 20*b* of a single compressor or passing from the discharge outlet of the first compressor 20*a* to the suction inlet of the second compressor 20*b*. Thus, in cooperation, the flash tank 70, the secondary expansion device 65 and the refrigerant vapor injection line 18 constitute an economizer circuit, with the flash tank 70 functioning as an economizer. The economizer circuit may also include a flow control valve 73 disposed in refrigerant vapor injection line 18 which may be selectively opened when the economizer circuit is called for to increase refrigeration capacity to meet refrigeration load demand and selectively closed when the economizer circuit is not needed to meet refrigeration load demand.

In the refrigerant vapor compression system 10, the flash tank 70 has both an economizer function and a refrigerant charge storage function. That is, the chamber 72 serves both as a separation chamber in which refrigerant vapor and refrigerant liquid separated, as described hereinbefore, and also as a buffer reservoir in which refrigerant may collect and be stored during periods of operation and during periods when the system is inactive. With respect to refrigerant vapor compression systems utilized in transport refrigeration units, in particular, due to wide variation in refrigeration capacity demand typically imposed on the refrigerant vapor compression system, for example from high demand during a temperature drawdown mode to relatively low demand during a box temperature maintenance mode, a significant amount of the internal volume of the chamber 72 of flash tank 70 may be needed for liquid refrigerant storage during operation of the system. With the chamber 72 providing a buffer reservoir, it is not necessary to incorporate an accumulator into the refrigerant flow circuit. Rather, as in the embodiment of the refrigerant vapor compression system depicted in FIG. 1, the flash tank 70 is sized with the internal volume defined by the chamber 72 providing sufficient volume that at the maximum volume of liquid refrigerant collecting within the chamber 72 during operation, adequate volume is provided above the maximum liquid level within the chamber 72 to ensure that the process of separation of the refrigerant vapor and refrigerant liquid will still occur unimpeded. Thus, in the refrigerant vapor compression system disclosed herein, the internal volume defined by the chamber 72 of the flash tank 70 is not sized simply to provide optimal refrigerant storage volume when the refrigerant vapor compression system is inactive.

In the refrigerant vapor compression system disclosed herein, the internal volume of the flash tank 70, that is the internal volume defined by the chamber 72, ranges between at least 10% up to 30% of a total system internal volume. In an embodiment of the refrigerant vapor compression system, the internal volume of the flash tank ranges from at about least 20% to about 30% of the total system internal volume. The total system internal volume equals the sum of the respective internal volumes of all the components and the refrigerant lines in the refrigerant flow circuit in which refrigerant may reside. In the refrigerant vapor compression system 10 depicted in FIG. 1, the total system internal volume includes an internal volume of the compression device 20, an internal volume of the refrigerant heat rejection heat exchanger 40, a total internal volume of the two expansion devices 65 and 75, an internal volume of the refrigerant heat absorption heat exchanger 50, a total internal volume of the plurality of refrigerant lines 2, 4, 6, 8, and the internal volume of the flash tank 70. For example, in an exemplary embodiment of a refrigerant vapor compression system for a transport refrigeration unit for conditioning a cargo space, the internal volume of the flash tank 70 may range from at least 0.1 cubic feet up to about 0.2 cubic feet. In an embodiment, the internal volume of the flash tank 70 may be about 0.15 cubic feet.

As noted previously, with the chamber 72 providing a buffer reservoir, it is not necessary to incorporate an accumulator into the refrigerant flow circuit. However, if desired, the refrigerant vapor compression system 10 may include a suction line accumulator 80 disposed in refrigerant line 6 between the refrigerant outlet of the evaporator 50, i.e. the refrigerant heat absorption heat exchanger, and the suction inlet to the compression device 20, as depicted in FIG. 2. The suction line accumulator 80 defines an internal volume in which any liquid refrigerant in the refrigerant vapor flowing through refrigerant line 6 will be collected, thereby preventing the liquid refrigerant from passing on to the compression device 20. Additionally, the internal volume of the suction line accumulator 80 provides a reservoir in which liquid refrigerant may collect and be stored during periods when the refrigerant vapor compression system 10 is inactive.

Thus, in the embodiment of the refrigerant vapor compression system 10 depicted in FIG. 2, both the flash tank 70 and the suction line accumulator 80 define internal volumes which act as buffer reservoirs for storing refrigerant. Therefore, the sum of the internal volume of the flash tank 70 and the internal volume of the suction line accumulator 80 totals to adequate volume above the maximum liquid level within the chamber 72, taking into consideration the internal volume of the suction line accumulator 80, to ensure that the process of separation of the refrigerant vapor and refrigerant liquid will still occur unimpeded. In this embodiment, the sum of the internal volume of the flash tank 70 and the internal volume of the suction line accumulator 80 totals to a volume in the range of between at least 10% up to 30% of a total system internal volume. In the refrigerant vapor compression system 10 depicted in FIG. 2, the total system internal volume includes an internal volume of the compression device 20, an internal volume of the refrigerant heat rejection heat exchanger 40, a total internal volume of the two expansion devices 65 and 75, an internal volume of the refrigerant heat absorption heat exchanger 50, a total internal volume of the plurality of refrigerant lines 2, 4, 6, 8, the internal volume of the flash tank 70, and the internal volume of the suction line accumulator 80.

While the present invention has been particularly shown and described with reference to the exemplary embodiments as illustrated in the drawing, it will be recognized by those skilled in the art that various modifications may be made without departing from the spirit and scope of the invention. For example, in an economized refrigerant vapor compression system wherein the economizing function is performed using a refrigerant-to-refrigerant heat exchanger, for example a brazed plate heat exchanger, instead of a flash tank, the internal volume of a suction line accumulator incorporated into the system should have an internal volume sized to provide a volume between 10% up to 30% of the total system internal volume to provide adequate volume for phase separation in addition to liquid refrigerant storage during operation.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

Therefore, it is intended that the present disclosure not be limited to the particular embodiment(s) disclosed as, but that the disclosure will include all embodiments falling within the scope of the appended claims.

I claim:

1. A refrigerant vapor compression system comprising a plurality of components connected in a refrigerant flow circuit by a plurality of refrigerant lines, said components including at least a compression device, a refrigerant heat rejection heat exchanger, a primary expansion device, a refrigerant heat absorption heat exchanger, and a flash tank;

each of said components defining an internal volume and the plurality of refrigerant lines defining an internal volume, the system volume equal to the sum of the internal volumes of said component volumes and the internal volume of the plurality of refrigerant lines, and the internal volume of the flash tank ranging from at least 10% to about 30% of the system volume;

wherein the flash tank is disposed in the refrigerant flow circuit between the refrigerant heat rejection heat exchanger and the refrigerant heat absorption heat exchanger.

2. The refrigerant vapor compression system as recited in claim 1 wherein the internal volume of the flash tank ranges from at about least 20% to about 30% of the system volume.

3. The refrigerant vapor compression system as recited in claim 1 wherein the internal volume of the flash tank ranges from at least 0.1 cubic feet up to about 0.2 cubic feet.

4. The refrigerant vapor compression system as recited in claim 3 wherein the internal volume of the flash tank is about 0.15 cubic feet.

5. The refrigerant vapor compression system as recited in claim 1 further comprising an economizer circuit operatively associated with the refrigerant flow circuit, the economizer including a refrigerant vapor injection line connecting the chamber of the flash tank in refrigerant vapor flow communication with an intermediate pressure stage of the compression device.

6. The refrigerant vapor compression system as recited in claim 1 wherein said refrigerant is carbon dioxide.

7. A refrigerant vapor compression system for a transport refrigeration unit for conditioning a cargo space, comprising:

a compression device;

a refrigerant heat rejection heat exchanger;

at least one expansion device;

a refrigerant heat absorption heat exchanger;

a flash tank defining a chamber having an internal volume; and a plurality of refrigerant lines connecting the compression device, the refrigerant heat rejection heat exchanger, the at least one expansion device, the refrigerant heat absorption heat exchanger and the flash tank in a refrigerant flow circuit;

the internal volume of the flash tank having a volume between at least 10% up to 30% of a total system internal volume.

8. The refrigerant vapor compression system as recited in claim 7 wherein the internal volume of the flash tank ranges from at about least 20% to about 30% of the system volume.

9. The refrigerant vapor compression system as recited in claim 7 wherein the internal volume of the flash tank ranges from at least 0.1 cubic feet up to about 0.2 cubic feet.

10. The refrigerant vapor compression system as recited in claim 9 wherein the internal volume of the charge storage device is about 0.15 cubic feet.

11. The refrigerant vapor compression system as recited in claim 7 wherein said refrigerant is carbon dioxide.

12. The refrigerant vapor compression system as recited in claim 7 wherein the total system internal volume includes an internal volume of the compression device, an internal volume of the refrigerant heat rejection heat exchanger, an internal volume of the at least one expansion device, an internal volume of the refrigerant heat absorption heat exchanger, a total internal volume of the plurality of refrigerant lines and the internal volume of the flash tank.

13. The refrigerant vapor compression system as recited in claim 7 wherein the flash tank is disposed in the refrigerant flow circuit between the refrigerant heat rejection heat exchanger and the refrigerant heat absorption heat exchanger, and the at least one expansion device includes a primary expansion device disposed in the refrigerant flow circuit between the flash tank and the refrigerant heat absorption heat exchanger and a secondary expansion device disposed in the refrigerant flow circuit between the refrigerant heat rejection heat exchanger and the flash tank.

14. The refrigerant vapor compression system as recited in claim 13 wherein the plurality of refrigerant lines includes a refrigerant vapor injection line connecting the chamber of the flash tank to refrigerant vapor flow communication with an intermediate pressure stage of the compression device.

15. The refrigerant vapor compression system as recited in claim 14 further comprising a suction line accumulator interdisposed in the refrigerant flow circuit intermediate the refrigerant heat absorption heat exchanger and a suction inlet to the compression device, the suction line accumulator defining an internal volume, the sum of the internal volume of the flash tank and the internal volume of the suction line accumulator being up to 30% of the total system internal volume.

16. The refrigerant vapor compression system as recited in claim 7 wherein the refrigeration is carbon dioxide and the refrigerant vapor compression system is operable in a transcritical cycle.

17. A method for designing a refrigerant vapor compression system for operation in a transcritical cycle, the refrigerant vapor compression system having a plurality of components including at least a compression device, a refrigerant heat rejection heat exchanger, at least one expansion device, and a refrigerant heat absorption heat exchanger connected in a refrigerant flow circuit by a plurality of refrigerant lines, comprising:

providing a flash tank interdisposed in the refrigerant flow circuit intermediate the refrigerant heat rejection heat exchanger and the refrigerant heat absorption heat exchanger; and sizing an internal volume of the flash tank to provide sufficient volume that at the maximum volume of liquid refrigerant collecting within the flash tank during operation, adequate volume is provided above the maximum liquid level within the flash tank to ensure that the process of separation of the refrigerant vapor and refrigerant liquid will still occur unimpeded.

18. The method as recited in claim 17 further comprising:

sizing the internal volume of the flash tank to have a volume between 10% up to 30% of the total internal volume of the refrigerant vapor compression system.

19. The method as recited in claim 18 further comprising determining the total system internal volume by summing the respective internal volume of each of said plurality of components in the refrigerant flow circuit in which refrigerant may reside and the total internal volume of the refrigerant lines in the refrigerant flow circuit.

* * * * *